US008245527B2

(12) United States Patent
Ducharme et al.

(10) Patent No.: US 8,245,527 B2
(45) Date of Patent: Aug. 21, 2012

(54) ICE MAKING DEVICE

(76) Inventors: David R. Ducharme, Anderson, SC (US); Russell E. Watts, Starr, SC (US); Hiroki Kuratani, Nagano (JP)

( * ) Notice: Subject to any disclaimer, the term of this patent is extended or adjusted under 35 U.S.C. 154(b) by 669 days.

(21) Appl. No.: 12/389,224

(22) Filed: Feb. 19, 2009

(65) Prior Publication Data

US 2010/0205996 A1 Aug. 19, 2010

(51) Int. Cl.
*F25C 5/08* (2006.01)

(52) U.S. Cl. ..... 62/351; 62/340; 62/353

(58) Field of Classification Search ..... 62/341, 62/353, 351, 340; 439/165, 31; 174/86
See application file for complete search history.

(56) References Cited

U.S. PATENT DOCUMENTS

| | | | | |
|---|---|---|---|---|
| 1,980,734 | A * | 11/1934 | Sadtler | 219/417 |
| 3,127,471 | A * | 3/1964 | Greiner | 174/135 |
| 3,458,163 | A * | 7/1969 | Egerton-Smith | 248/67.5 |
| 4,002,041 | A * | 1/1977 | Canter | 62/137 |
| 5,056,321 | A | 10/1991 | Patrick | |
| 5,178,559 | A * | 1/1993 | Mello | 439/472 |
| 5,187,948 | A * | 2/1993 | Frohbieter | 62/351 |
| 5,582,754 | A * | 12/1996 | Smith et al. | 219/438 |
| 7,152,424 | B2 * | 12/2006 | Shoukyuu et al. | 62/351 |
| 7,485,806 | B1 * | 2/2009 | Gretz | 174/59 |
| 2003/0116215 | A1 * | 6/2003 | Miyamoto et al. | 138/157 |
| 2006/0266055 | A1 * | 11/2006 | Anderson et al. | 62/135 |
| 2009/0025401 | A1 * | 1/2009 | Heger et al. | 62/73 |

FOREIGN PATENT DOCUMENTS

JP 8-54164 A 2/1996

OTHER PUBLICATIONS

International Search Report for PCT/US2010/024421 dated Nov. 4, 2010, 2 pages.

* cited by examiner

*Primary Examiner* — Cheryl J Tyler
*Assistant Examiner* — Thomas Y Ho
(74) *Attorney, Agent, or Firm* — Pearne & Gordon LLP

(57) ABSTRACT

An ice making device may include an ice tray, a drive mechanism for moving the ice tray to a water-supply position and to an ice making position, a guide plate formed with a guide groove for guiding the ice tray to the water-supply position and to the ice making position, an engaging projection provided on the ice tray and engaged with the guide groove, a crank which is formed with a drive groove with which the engaging projection is engaged and which is connected with the drive mechanism for moving the ice tray, a heater which is mounted on the ice tray, and a connecting wire which is connected to the heater. The engaging projection is an engaging tube and is structured of two engaging tube pieces which are divided by a plane in an axial direction, and the connecting wire is drawn out by passing through an inner side of the engaging tube.

10 Claims, 10 Drawing Sheets

ICE MAKING DEVICE

FIELD OF THE INVENTION

An embodiment of the present invention may relate to an ice making device which is assembled into and used in a refrigerator.

BACKGROUND OF THE INVENTION

An ice making device for automatically making ice pieces has been conventionally known in which a heater is attached to an ice tray (see, for example, Japanese Patent Laid-Open No. Hei 8-54164). The ice making device described in this Patent Reference includes two arms which are fixed to each of both ends of the ice tray, an elevating/lowering member which supports the arms from a lower side to move the ice tray up and down, and a drive motor and a rotation body for moving the elevating/lowering member up and down.

The ice making device is structured so that two arms are moved up and down along a pair of guide grooves. One of the guide grooves is structured of a combination of a straight line region and a curved region which is disposed on its lower side, and the other of the guide grooves is structured of only a straight line region. Therefore, when the elevating/lowering member is moved lower than the straight line region of the guide groove, only one of the arms is moved downward along the curved region of the one of the guide grooves and thus the ice tray is turned 90° (90 degree) with the other arm as a turning center. Further, when the ice tray is turned 90° (90 degree), ice pieces whose contacting portions with the ice tray are warmed by a heater and are melted are chopped from the ice tray.

In the ice making device described in the Patent Reference, connecting wires are connected to the heater which is mounted on the ice tray. On the other hand, since the ice tray is moved up and down and turned, treatment of the connecting wires drawn out from the ice tray is a problem to be solved. However, in the ice making device described in the Patent Reference, treatment of the connecting wires drawn out from the heater is not disclosed.

SUMMARY OF THE INVENTION

In view of the problem described above, at least an embodiment of the present invention may be advantageously provide an ice making device in which a connecting wire drawn out from a heater that is mounted on an ice tray is capable of being easily and appropriately treated.

According to at least an embodiment of the present invention, there may be provided an ice making device including an ice tray, a drive mechanism for moving the ice tray to a water-supply position where water is supplied to the ice tray and to an ice making position where the water in the ice tray is frozen, a guide plate which is formed with a guide groove for guiding the ice tray to the water-supply position and to the ice making position, an engaging projection which is provided on the ice tray and engaged with the guide groove, a crank which is formed with a drive groove with which the engaging projection is engaged and which is connected with the drive mechanism for moving the ice tray, a heater which is mounted on the ice tray, and a connecting wire which is connected to the heater. The engaging projection is an engaging tube which is structured of two engaging tube pieces. The two engaging tube pieces are divided by a plane in an axial direction and the connecting wire is drawn out by passing through an inner side of the engaging tube.

In the ice making device in accordance with an embodiment of the present invention, the connecting wire which is connected to the heater is drawn out by passing through an inner side of the engaging tube, which is engaged with the guide groove and the drive groove. Therefore, damage of the connecting wire caused by biting of the connecting wire can be prevented when the ice tray is moved between the water-supply position and the ice making position. Further, in accordance with an embodiment of the present invention, the engaging tube is provided with two engaging tube pieces which are divided by a plane in the axial direction. Therefore, after the connecting wire has been disposed within one of the engaging tube pieces, the other engaging tube piece is joined with the one of the engaging tube pieces and, as a result, the connecting wire can be drawn out by passing through the inner side of the engaging tube. Accordingly, drawing operation of the connecting wire is easily performed. As described above, in the embodiment of the present invention, the connecting wire drawn out from the heater which is mounted on the ice tray is easily and appropriately treated.

In accordance with an embodiment of the present invention, a dividing face of the engaging tube which is an abutting face of the two engaging tube pieces is formed to be substantially parallel to a horizontal plane. According to this structure, even when the guide groove is contacted with the engaging projection by the own weight of the ice tray when the ice tray is moved between the water-supply position and the ice making position, the guide groove is hardly contacted with the joining part of the two engaging projection pieces. Accordingly, even when the guide groove is contacted with the engaging projection by the own weight of the ice tray, a frictional force between the engaging projection and the guide groove can be reduced and thus a driving force of the drive mechanism can be reduced. Further, abrasion of the engaging projection and the guide groove can be restrained.

In accordance with an embodiment of the present invention, the engaging tube is formed in a roughly cylindrical shape, and the dividing face of the engaging tube is formed on a plane passing through an axial center of the engaging tube. According to this structure, opening portions of the engaging projection pieces formed on the dividing face of the engaging projection become wider and thus arranging operation of the connecting wire within the engaging projection piece becomes easy. Further, according to this structure, when the dividing face of the engaging projection is substantially parallel to the horizontal plane, the guide groove is hardly contacted with the joining part of the two engaging projection pieces even when the guide groove is contacted with the engaging projection by the own weight of the ice tray.

In accordance with an embodiment of the present invention, a connector is connected with an end part of the connecting wire and an inner diameter of the engaging tube is smaller than an outer shape of the connector. According to this structure, the diameter of the engaging projection may be made smaller. In accordance with an embodiment of the present invention, since the engaging projection is provided with two engaging projection pieces which are divided by a plane parallel to the axial direction, even in the state where the connector has been previously connected with the end part of the connecting wire, the connecting wire can be drawn by passing through the inner side of the engaging projection.

In accordance with an embodiment of the present invention, the ice tray is formed with a recessed part for fixing the engaging tube piece, and the engaging tube piece is formed with a plate part which is disposed in the recessed part. According to this structure, mounting operation of the engaging tube to the ice tray is easy.

In this case, it is preferable that the plate part is provided in one of the two engaging tube pieces and is formed with an abutting part which abuts with a wall face of the recessed part, and the other of the two engaging tube pieces is fixed to the one of the two engaging tube pieces and, when the one of the two engaging tube pieces is fixed to the recessed part, the abutting part is abutted with the wall face of the recessed part so that a direction to the ice tray of the engaging tube structured of the two engaging tube pieces is determined. Further, it is preferable that the plate part is provided in one of the two engaging tube pieces, and the other of the two engaging tube pieces is formed with an aperture groove for passing the connecting wire through the inner side of the engaging tube structured of the two engaging tube pieces. According to the structure as described above, the engaging tube is fixed to the ice tray so as to be protruded without inclination, and further, even when the connecting wire is disposed on the outer side of the ice tray, the connecting wire can be easily passed through the inner side of the engaging tube.

In accordance with an embodiment of the present invention, the ice making device is provided with two cranks which are connected with the drive mechanism for moving the ice tray, and one of the two cranks is formed with the drive groove with which the engaging tube is engaged. Further, it is preferable that the drive mechanism includes a motor as a drive source and a gear mechanism which is driven by the motor and the drive mechanism is mounted on one of two guide plates, and one ends of the two cranks are fixed to a crank turning shaft whose both ends are turnably held by the two guide plates so as to be turnable with the crank turning shaft as a center, and the two cranks are turned at both sides of the ice tray by the crank turning shaft which is turned through the gear mechanism, and the guide groove with which the engaging tube is engaged is formed in the other of the two guide plates. According to the structure as described above, the drawing direction of the connecting wire and the drive mechanism are disposed on opposite directions of two guide plates with respect to the ice tray and thus a structure of the ice making device can be simplified.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

An embodiment of the present invention will be described below with reference to the drawings.

Figure 1:
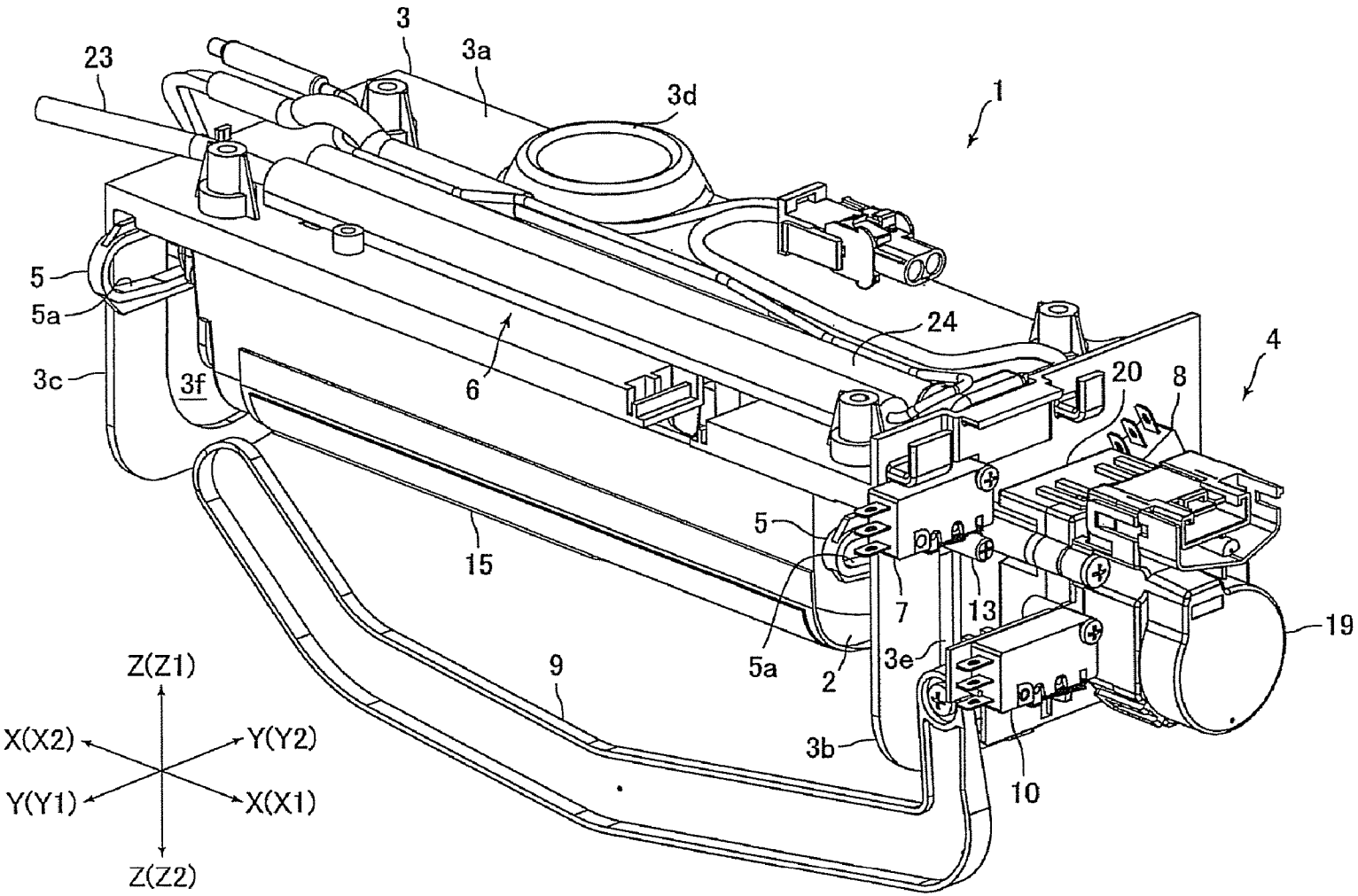
FIG. 1 is a perspective view showing an ice making device in accordance with an embodiment of the present invention.
Figure 2:
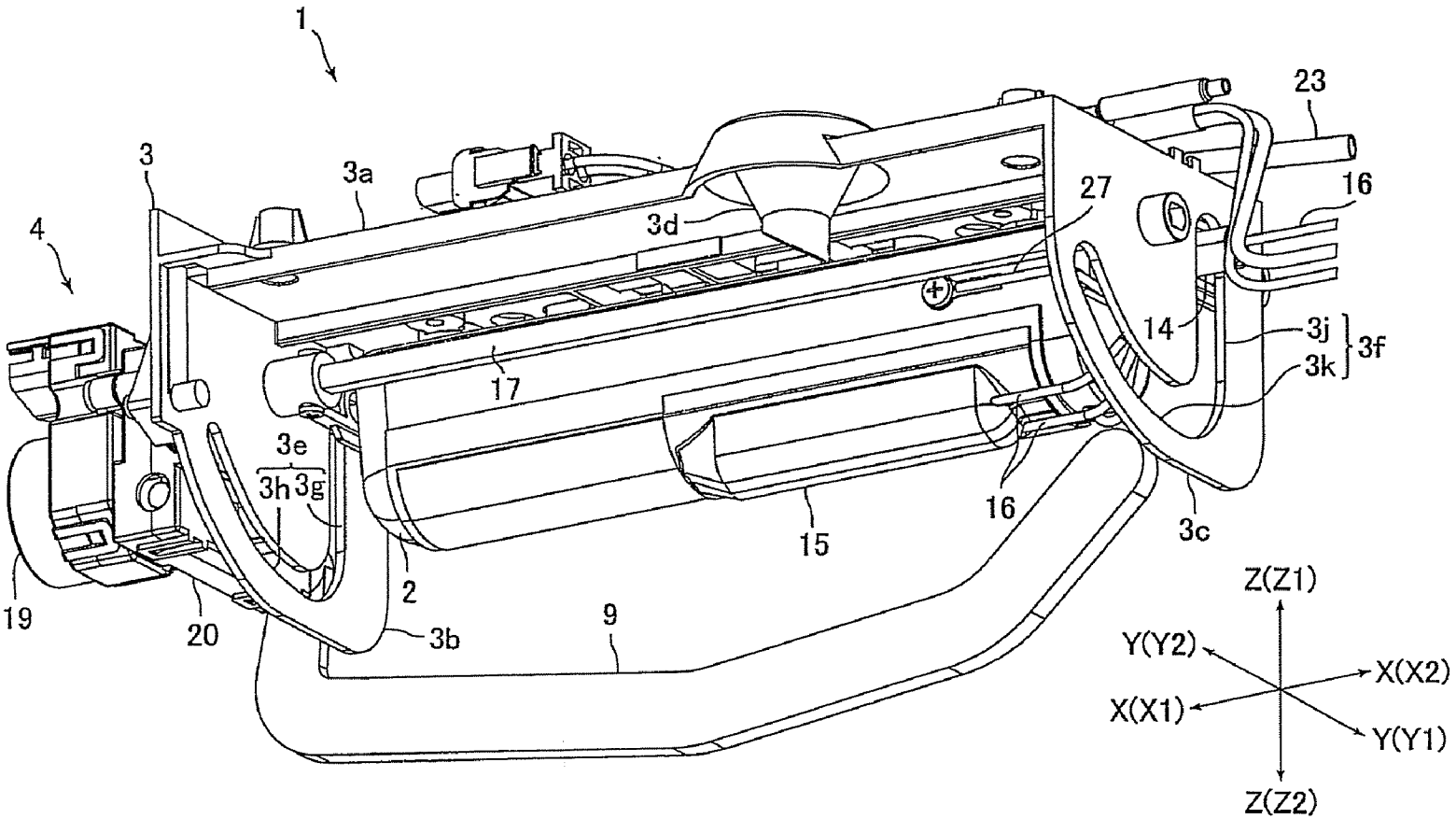
FIG. 2 is a perspective view showing the ice making device shown in FIG. 1 which is viewed from a different direction.
Figure 3:
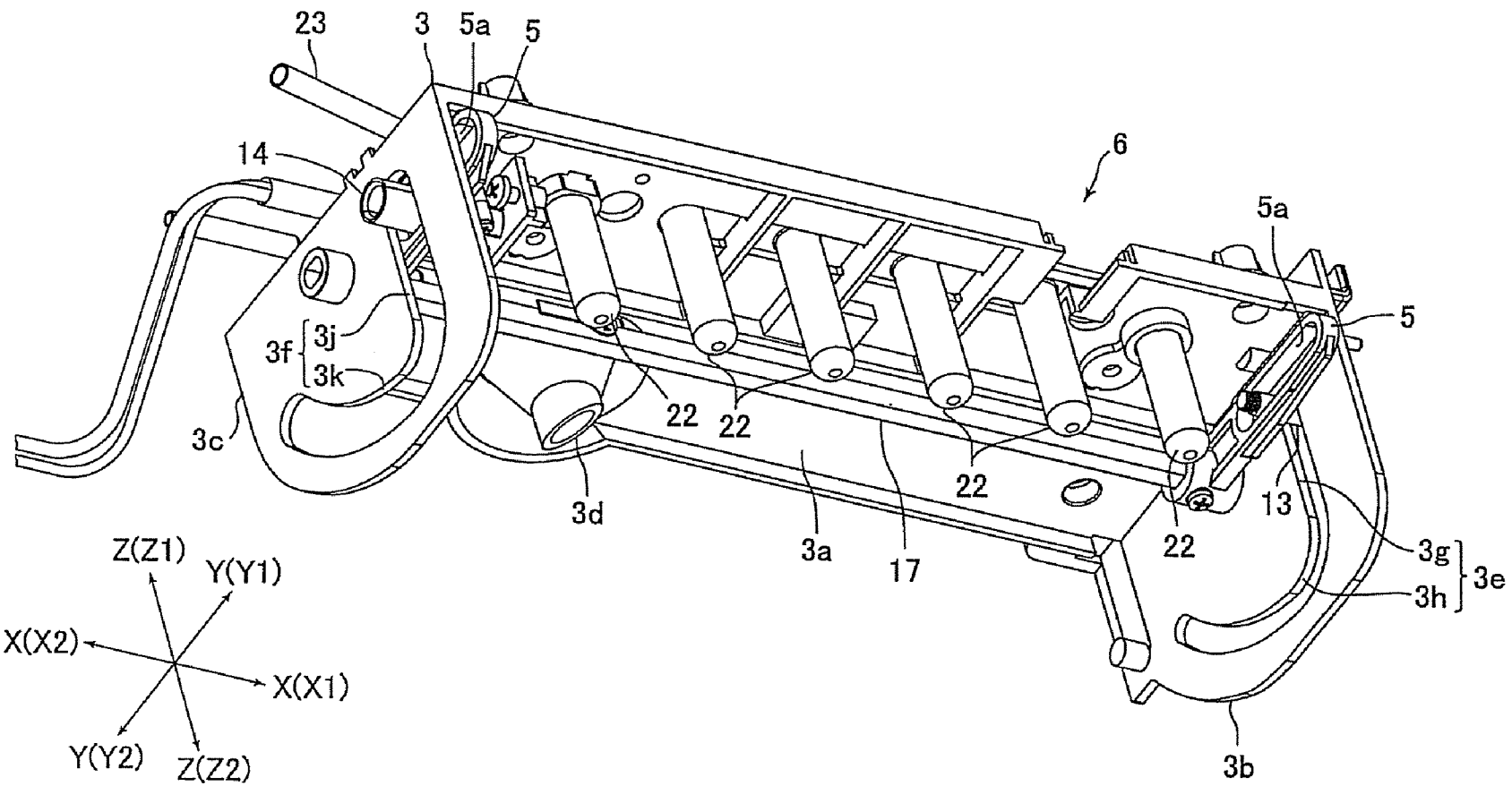
FIG. 3 is a perspective view showing a state where an ice tray and the like are detached from the ice making device shown in FIG. 1, and which is viewed from a different direction.

FIG. 1 is a perspective view showing an ice making device 1 in accordance with an embodiment of the present invention. FIG. 2 is a perspective view showing the ice making device 1 shown in FIG. 1 which is viewed from a different direction. FIG. 3 is a perspective view showing a state where an ice tray 2 and the like are detached from the ice making device 1 shown in FIG. 1, and which is viewed from a different direction.

In the following description, as shown in FIG. 1, three directions perpendicular to each other are set to be X-direction, Y-direction and Z-direction. Further, in the following description, the X1-direction side is set to be "right" side, the X2-direction side is set to be "left" side, the Y1-direction side is set to be "front (or before)" side, the Y2-direction side is set to be "rear" (or back) side, the Z1-direction side is set to be "upper" side, and the Z2-direction side is set to be "lower" side. Further, in the following description, a plane which is formed by the X-direction and the Y-direction is set to be XY-plane, and a plane which is formed by the Y-direction and the Z-direction is set to be YZ-plane.

The ice making device 1 in this embodiment is, for example, used in a refrigerator for making ice pieces automatically. The ice making device 1 is provided with an ice tray 2 and the ice tray 2 is moved to a water-supply position where water is supplied to the ice tray 2 and to an ice making position where water in the ice tray 2 is frozen. In this embodiment, the position of the ice tray 2 when the ice tray 2 is disposed on an underside of a water-supply part 3*d* is a water-supply position (see FIG. 4(A)), and the position of the ice tray 2 when cooling bodies 22 are entered into the ice tray 2 is an ice making position (see FIG. 4(B)).

The ice making device 1 includes the ice tray 2, a frame 3, a drive mechanism 4 for moving the ice tray 2 to the water-supply position and to the ice making position, two cranks 5 which are connected with the drive mechanism 4 for moving the ice tray 2, a cooling mechanism 6 for freezing water in the ice tray 2, a first sensor 7 and a second sensor 8 for detecting a position of the ice tray 2, an ice detecting lever 9 for detecting a remaining amount of ice pieces in an ice storage container (not shown) where ice pieces are stored, and a third sensor 10 for detecting a position of the ice detecting lever 9.

The frame 3 includes a top plate part 3*a* which is parallel to the XY-plane and formed in a roughly flat plate shape, and two side plate parts 3*b* and 3*c* which are parallel to the YZ-plane and formed in a roughly flat plate shape. The frame 3 is, as a whole, formed in a roughly rectangular groove shape. The side plate part 3*b* is formed downward from a right-side end of the top plate part 3*a* and the side plate part 3*c* is formed downward from a left-side end of the top plate part 3*a*.

A water-supply part 3*d* for supplying water into the ice tray 2 is formed on the back end side of the top plate part 3*a*. A water-supply mechanism not shown in the drawing is connected with an upper end of the water-supply part 3*d* and water is supplied into the ice tray 2 from a lower end of the water-supply part 3*d*.

The side plate part 3*b* is formed with a guide groove 3*e*, which penetrates through the side plate part 3*b*, for guiding the ice tray 2 to the water-supply position and to the ice making position. Similarly, the side plate part 3*c* is formed with a guide groove 3*f*, which penetrates through the side plate part 3*c*, for guiding the ice tray 2 to the water-supply position and to the ice making position. In this embodiment, the side plate parts 3*b* and 3*c* are guide plates in which the guide grooves 3*e* and 3*f* for guiding the ice tray 2 are formed.

The guide groove 3*e* is formed so that its shape viewed from the right and left direction is in a substantially "J" shape. Specifically, as shown in FIGS. 2 and 3, the guide groove 3*e* is structured of a first groove part 3*g*, which is substantially parallel to the vertical direction and formed in a straight-line shape, and a second groove part 3*h* which is formed in a curved-shape. The first groove part 3*g* is formed on a front end side of the side plate part 3*b*. The second groove part 3*h* is formed to be connected with a bottom end of the first groove part 3*g* and formed toward the back side from the bottom end of the first groove part 3*g*.

Similarly, the guide groove 3*f* is formed so that its shape viewed from the right and left direction is in a substantially "J" shape. In other words, the guide groove 3*f* is structured of a first groove part 3*j*, which is substantially parallel to the vertical direction and formed in a straight-line shape, and a second groove part 3*k* which is formed in a curved-shape. The first groove part 3*j* is formed on a front end side of the side plate part 3*c*. The second groove part 3*k* is formed to be connected with a bottom end of the first groove part 3*j* and formed toward the back side from the bottom end of the first groove part 3*j*. In this embodiment, a width of the guide groove 3*f* is set to be wider than a width of the guide groove 3*e*.

The ice tray 2 is disposed on a lower side of the top plate part 3*a* and between the side plate parts 3*b* and 3*c* in the right and left direction. A cylindrical engaging pin 13 which is engaged with the guide groove 3*e* is mounted on an upper end side of the right-side end of the ice tray 2 so as to protrude in the right direction. An engaging tube 14 as an engaging projection which is engaged with the guide groove 3*f* is mounted on an upper end side of the left-side end of the ice tray 2 so as to protrude in the left direction. The engaging tube 14 is formed in a roughly cylindrical shape having a longitudinal axis. Further, in the front and rear direction, the engaging pin 13 and the engaging tube 14 are mounted at a substantially center position of the ice tray 2. An outer diameter of the engaging pin 13 is set to be smaller than a width of the guide groove 3*e*. Further, an outer diameter of the engaging tube 14 is set to be smaller than a width of the guide groove 3*f*.

The engaging pin 13 is inserted into the guide groove 3*e* and a drive groove 5*a* which is formed in the crank 5. The right-side end of the engaging pin 13 is protruded toward the right side from the right side face of the side plate part 3*b*. Further, the engaging tube 14 is inserted into a drive groove 5*a* and the guide groove 3*f*, and the left-side end of the engaging tube 14 is protruded toward the left side from the left side face of the side plate part 3*c*.

As shown in FIG. 2, a heater 15 is mounted on an under face of the ice tray 2. Connecting wires 16 are connected to the heater 15. In this embodiment, two connecting wires 16 are connected to the heater 15. The connecting wires 16 are drawn out to the left side from the ice making device 1. Detailed structure about a drawing portion of the connecting wires 16 will be described below.

One end side of the crank 5 is fixed to a crank turning shaft 17, whose both ends are turnably supported by the side plate parts 3*b* and 3*c* of the frame 3, and the crank 5 is turnable with the crank turning shaft 17 as its turning center. Two cranks 5 are disposed on inner sides of the side plate parts 3*b* and 3*c* in the right and left direction. Further, the two cranks 5 are disposed on outer sides of the ice tray 2 in the right and left direction.

The crank 5 is formed with the drive groove 5*a*, with which the engaging pin 13 or the engaging tube 14 is engaged, so as to penetrate through the crank 5 in the right and left direction and which is formed in a substantially linear manner. A width of the drive groove 5*a* with which the engaging pin 13 is engaged is set to be larger than an outer diameter of the engaging pin 13. Further, a width of the drive groove 5*a* with which the engaging tube 14 is engaged is set to be larger than an outer diameter of the engaging tube 14.

The crank turning shaft 17 is held by the side plate parts 3*b* and 3*c* on upper end sides of the side plate parts 3*b* and 3*c*. Further, in the front and rear direction, the crank turning shaft 17 is disposed at roughly center positions of the side plate parts 3*b* and 3*c*. The right-side end of the crank turning shaft 17 is connected with a gear mechanism 20 which structures the drive mechanism 4.

In this embodiment, when the crank 5 is turned with the crank turning shaft 17 as its turning center, the engaging pin 13 and the engaging tube 14 which are engaged with the drive grooves 5*a* are moved along the guide grooves 3*e* and 3*f*. In other words, when the cranks 5 are turned with the crank turning shaft 17 as its turning center, the ice tray 2 is moved along the guide grooves 3*e* and 3*f*.

The drive mechanism 4 is provided with a motor 19 as a drive source and a gear mechanism 20 for transmitting power of the motor 19 to the crank turning shaft 17. The gear mechanism 20 is fixed to a right side face of the side plate part 3*b*. Further, the motor 19 is fixed to a right side face of the gear mechanism 20.

Figure 5A:
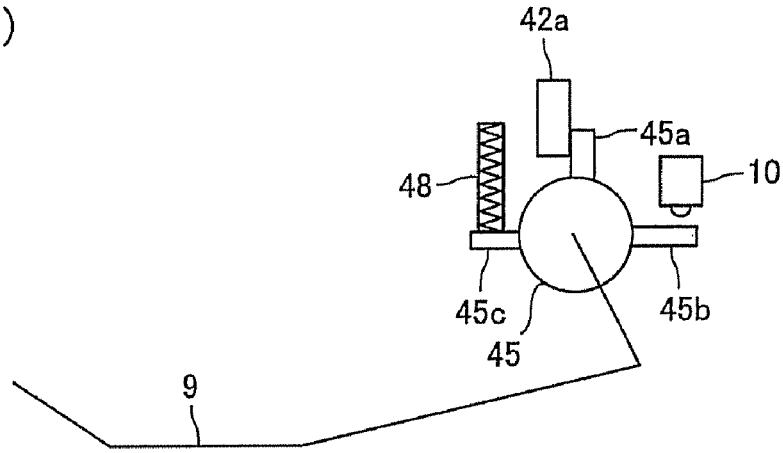
FIGS. 5(A) through 5(C) are views for explaining movement of an ice detecting lever shown in FIG. 1.
Figure 5B:
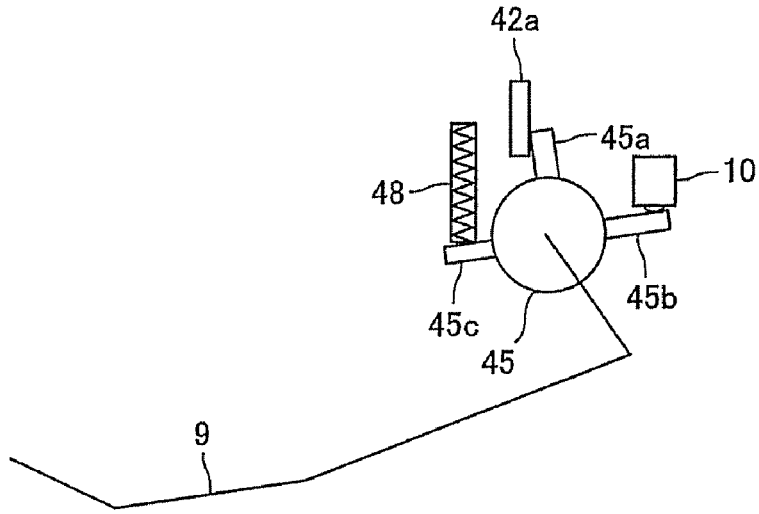
Figure 5C:
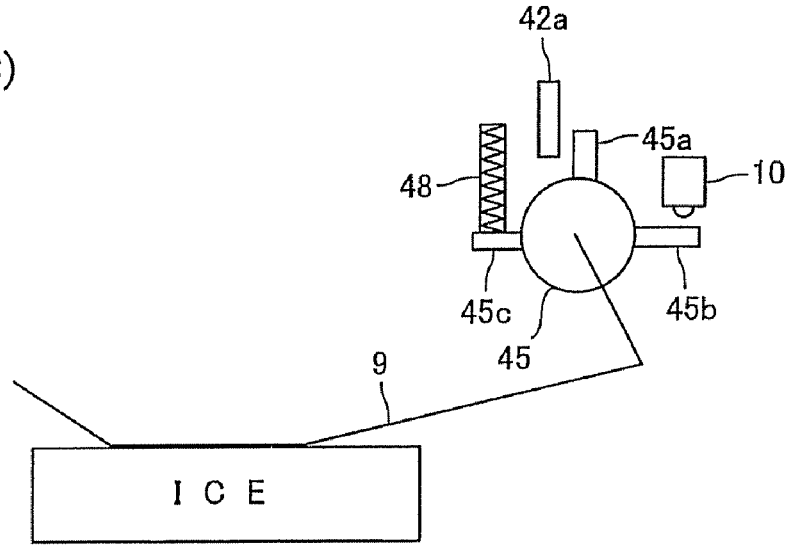

The gear mechanism 20 is provided with a plurality of gears (not shown), a lever turning shaft 45 for turning the ice detecting lever 9, and a compression coil spring 48 for urging the lever turning shaft 45 in a direction in which the ice detecting lever 9 is moved downward (see FIGS. 5(A) through 5(C)). A cam 42*a* for turning the lever turning shaft 45 is formed on a right-side end face of one of a plurality of the gears (see FIGS. 5(A) through 5(C)). Further, the ice detecting lever 9 is fixed on the front end of the lever turning shaft 45, and the ice detecting lever 9 is turned with the front and rear direction as its axial direction.

The lever turning shaft 45 is formed with a cam abutting part 45*a* which is capable of abutting with the cam 42*a*, a sensor abutting part 45*b* which is capable of abutting with the third sensor 10, and a pressed part 45*c* which is pressed by the compression coil spring 48 (see FIGS. 5(A) through 5(C)). In this embodiment, the lever turning shaft 45 is urged in a counterclockwise direction in FIGS. 8(A) through 8(C) by the compression coil spring 48. In other words, the lever turning shaft 45 is urged by the compression coil spring 48 in a direction that the cam abutting part 45*a* is moved toward the cam 42*a*.

The cooling mechanism 6 is provided with a plurality of cooling bodies 22 for freezing water which enter into the ice tray 2 from an upper side of the ice tray 2 located at the ice making position, a refrigerant pipe 23 through which refrigerant for cooling the cooling bodies 22 is passed, a heater 24 for heating the cooling bodies 22 when ice pieces stuck to the cooling bodies 22 are to be dropped. The cooling bodies 22 are, as shown in FIG. 3, mounted on the top plate part 3*a* so as to protrude downward from the front end side of the top plate part 3*a* of the frame 3. The refrigerant pipe 23 and the heater 24 are mounted on an upper face of the front end side of the top plate part 3*a*.

A first sensor 7 and a second sensor 8 are mechanical contact switches which are provided with a lever member and a contact part. The first sensor 7 and the second sensor 8 are, as shown in FIG. 1, fixed to the right side face of the side plate part 3*b*. Specifically, the first sensor 7 is fixed to the upper end of the first groove part 3*g* of the guide groove 3*e* and the second sensor 8 is fixed to the upper end of the second groove part 3*h* of the guide groove 3*e*. In this embodiment, the engaging pin 13 fixed to the ice tray 2 is abutted with the lever member of the first sensor 7 to press the contact part and, as a result, the ice tray 2 is detected to be located at the ice making position. Further, the engaging pin 13 is abutted with the lever member of the second sensor 8 to press the contact part and, as a result, the ice tray 2 is detected to be located at the water-supply position.

A third sensor 10 is, similarly to the first sensor 7 and the second sensor 8, a mechanical contact switch which is provided with a lever member and a contact part. The third sensor 10 is fixed to a right side face of the gear mechanism 20. In this embodiment, the sensor abutting part 45*b* of the lever turning shaft 45 is abutted with the lever member of the third sensor 10 to press the contact part and, as a result, it is detected that remaining amount of ice pieces in the ice storage container is a little.

FIGS. 4(A) through 4(E) are views for explaining an ice making operation in the ice making device 1 shown in FIG. 1. FIGS. 5(A) through 5(C) are views for explaining movement of an ice detecting lever 9 shown in FIG. 1.

Figure 4A:
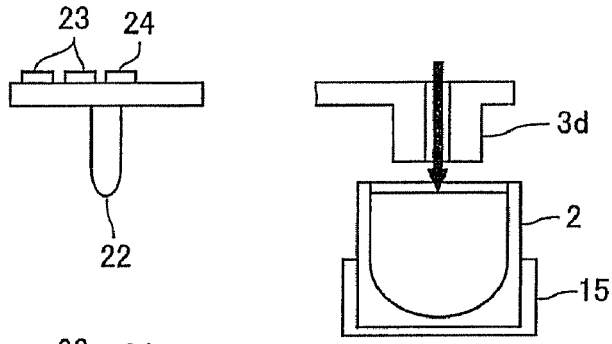
FIGS. 4(A) through 4(E) are views for explaining an ice making operation in the ice making device shown in FIG. 1.

In the ice making device 1 structured as above, ice pieces are made as follows. First, as shown in FIG. 4(A), water is supplied into the ice tray 2 located at the water-supply position. In other words, water is supplied into the ice tray 2 which is disposed on an under side of the water-supply part 3*d*. When the ice tray 2 is located at the water-supply position, the engaging pin 13 is disposed on the upper end of the second groove part 3*h* of the guide groove 3*e*, and the engaging tube 14 is disposed on the upper end of the second groove part 3*k* of the guide groove 3*f*.

Figure 4B:
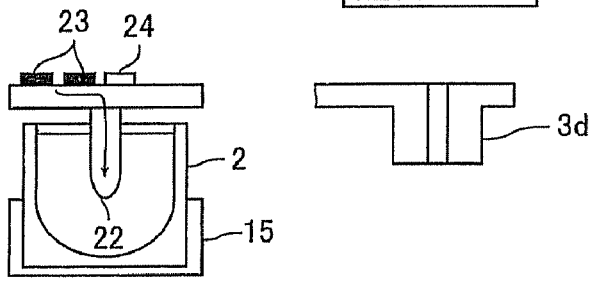

Next, the cranks 5 are turned to move the ice tray 2 to the ice making position where the engaging pin 13 is disposed on the upper end of the first groove part 3*g* and the engaging tube 14 is disposed on the upper end of the first groove part 3*j* (see FIG. 4(B)). When the ice tray 2 is moved to the ice making position, the cooling bodies 22 are entered into the ice tray 2. In this state, refrigerant is passed through the refrigerant pipe 23 to cool the cooling bodies 22 and water in the ice tray 2 is frozen.

Figure 4C:
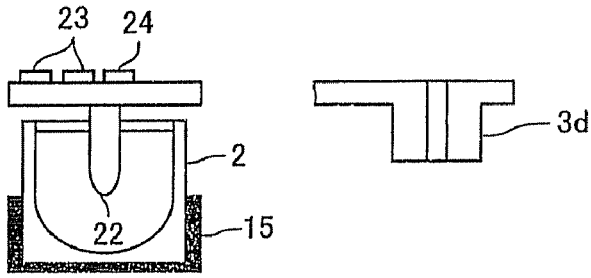
Figure 4D:
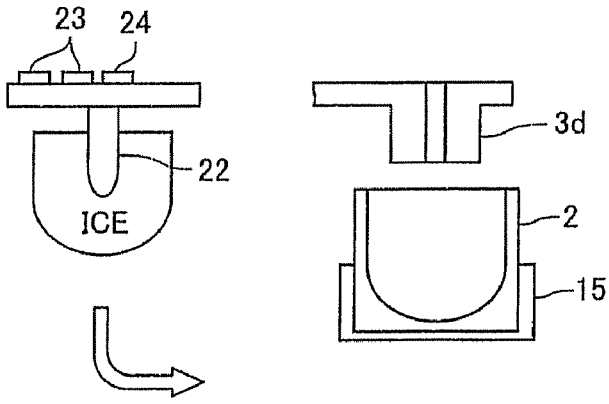
Figure 4E:
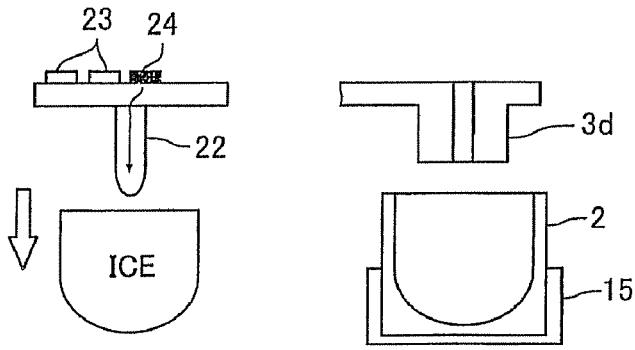

Next, as shown in FIG. 4(C), the heater 15 is set to be an "ON" state. When the heater 15 is turned on, contacting portion of ice with the ice tray 2 is melted. Next, as shown in FIG. 4(D), the cranks 5 are turned to move the ice tray 2 to the water-supply position. In this state, ice pieces have remained to stick to the cooling bodies 22. Next, as shown in FIG. 4(E), the heater 24 is set to be an "ON" state and the cooling bodies 22 are heated. When the cooling bodies 22 are heated, the ice pieces which have been stuck to the cooling bodies 22 drop into the ice storage container.

The ice making operation described above is performed when a remaining amount of ice pieces is a little in the ice storage container. Specifically, a remaining amount of ice pieces in the ice storage container is detected as described below to determine whether the ice making operation is performed or not. In other words, as shown in FIG. 5(A), first, when the ice tray 2 is located at the water-supply position, the cam abutting part 45*a* is abutted with the cam 42*a* and the ice detecting lever 9 is located at an upper position. In this case, the third sensor 10 is in an "OFF" state.

In this state, when the motor 19 is driven in order to move the ice tray 2 to the ice making position, the gear mechanism 20 is operated and, as shown in FIGS. 5(B) and 5(C), the cam 42*a* is retreated. In other words, the cam 42*a* is retreated in cooperation with movement of the ice tray 2. When a remaining amount of ice pieces in the ice storage container is a little or there is no ice piece in the ice storage container, as shown in FIG. 5(B), the detection lever 9 is moved down by an urging force of the compression coil spring 48 and the own weight of the detection lever 9 to turn the third sensor 10 in an "ON" state. When the third sensor 10 is turned to be an "ON" state, it is judged that a remaining amount of ice pieces in the ice storage container is a little, in other words, it is judged that an ice making operation is required and thus the ice tray 2 is continuously moved as it is to the ice making position to perform an ice making operation.

On the other hand, in a case that a remaining amount of ice pieces in the ice storage container is much, even when the cam 42*a* is retreated, as shown in FIG. 5(C), the detection lever 9 is contacted with ice pieces in the ice storage container and is not moved down. Therefore, the third sensor 10 is not turned in an "ON" state. When the third sensor 10 is not turned in an "ON" state, it is judged that a remaining amount of ice pieces in the ice storage container is much, in other words, it is judged that an ice making operating is not required and then, the ice tray 2 is returned to the water-supply position again to stand by.

In this embodiment, the ice tray 2 normally stands by at the water-supply position. Further, in this embodiment, the ice tray 2 starts to move to the ice making position with a regular interval and, when an ice making operation is required, the ice tray 2 is continuously moved to the ice making position and, when an ice making operation is not required, the ice tray 2 is returned to the water-supply position again.

Figure 6:
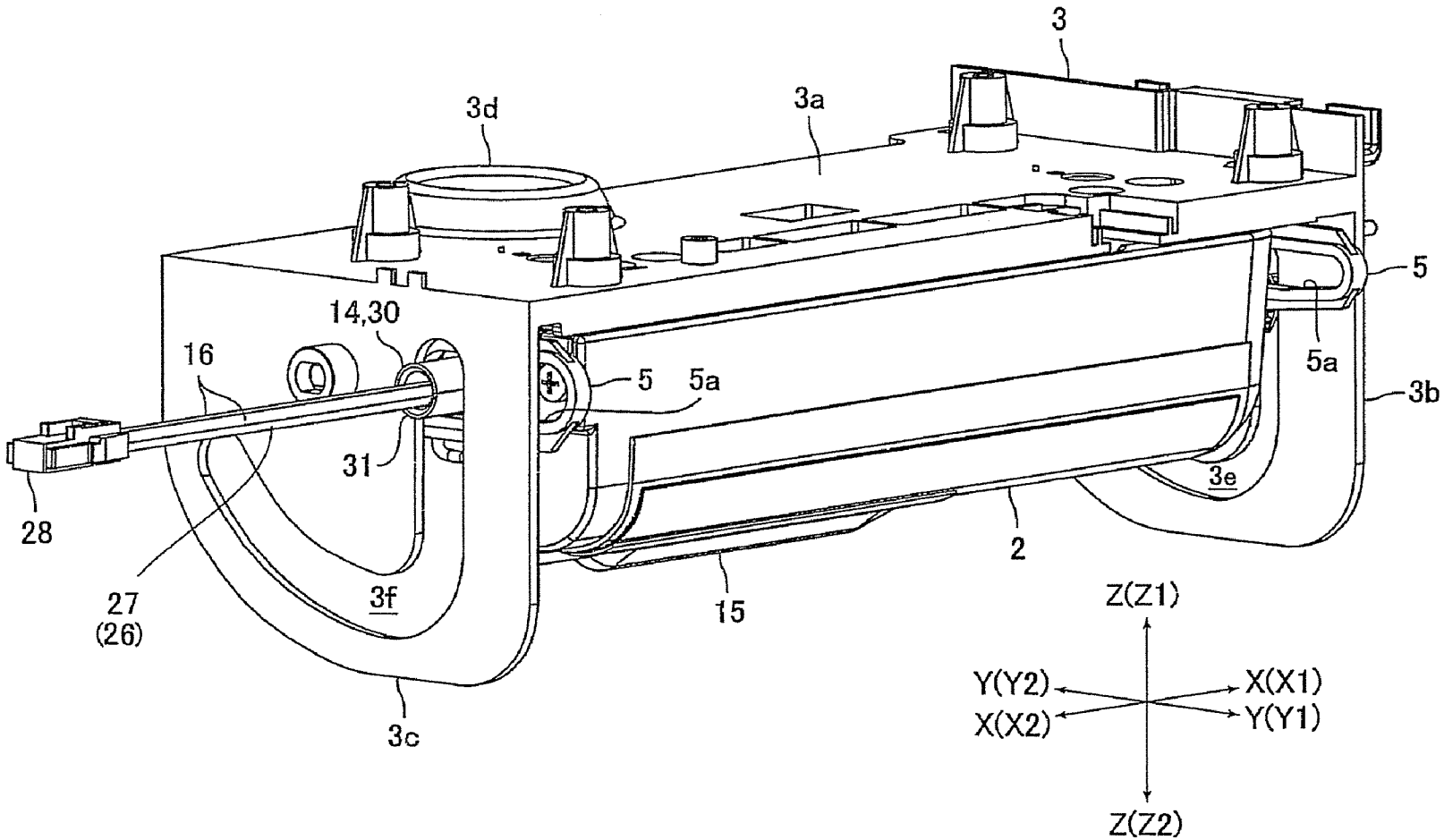
FIG. 6 is a perspective view showing a state where a cooling mechanism and the like are detached from the ice making device shown in FIG. 1, and which is viewed from a different direction.
Figure 7:
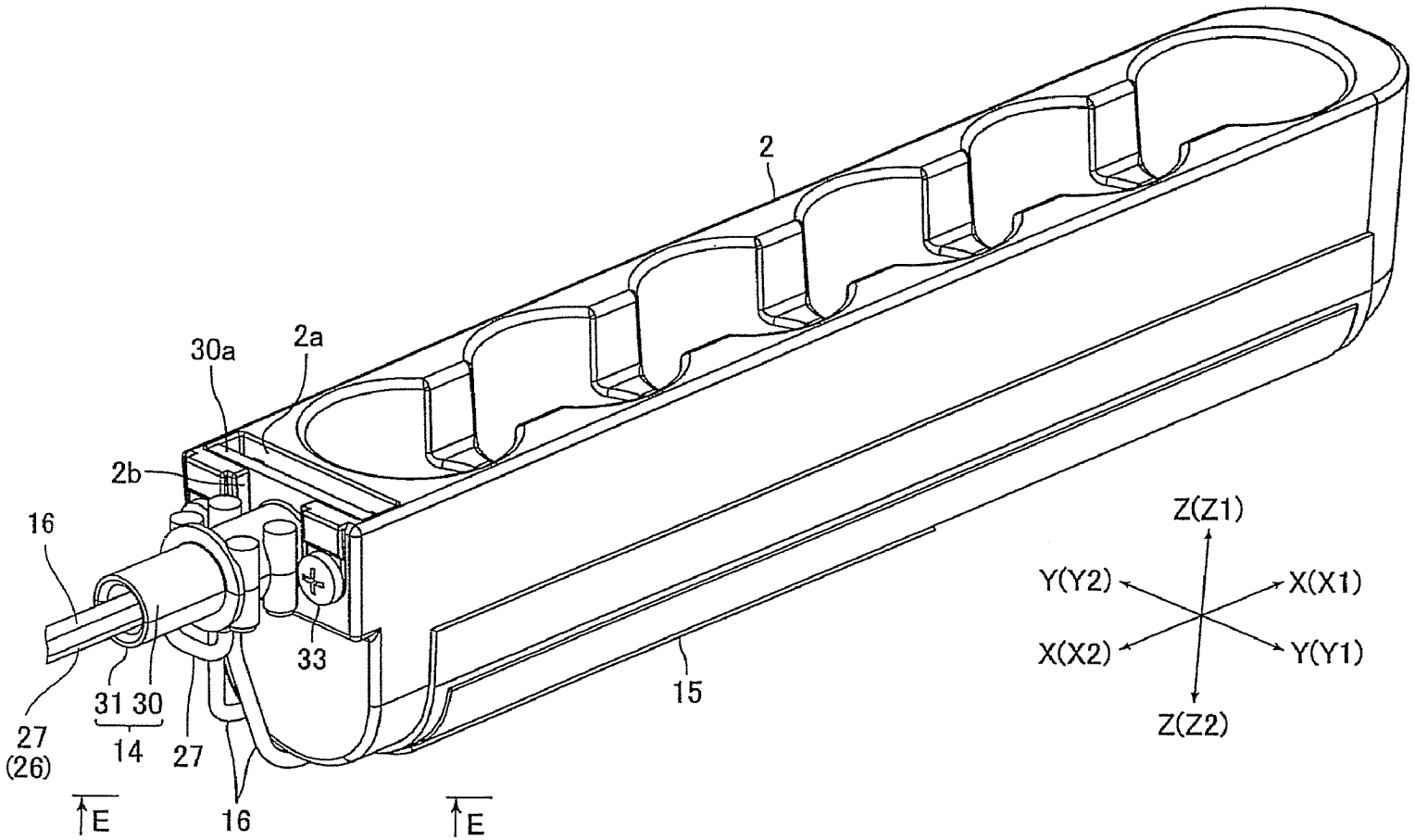
FIG. 7 is a perspective view showing an ice tray, an engaging tube and the like shown in FIG. 6.
Figure 8:
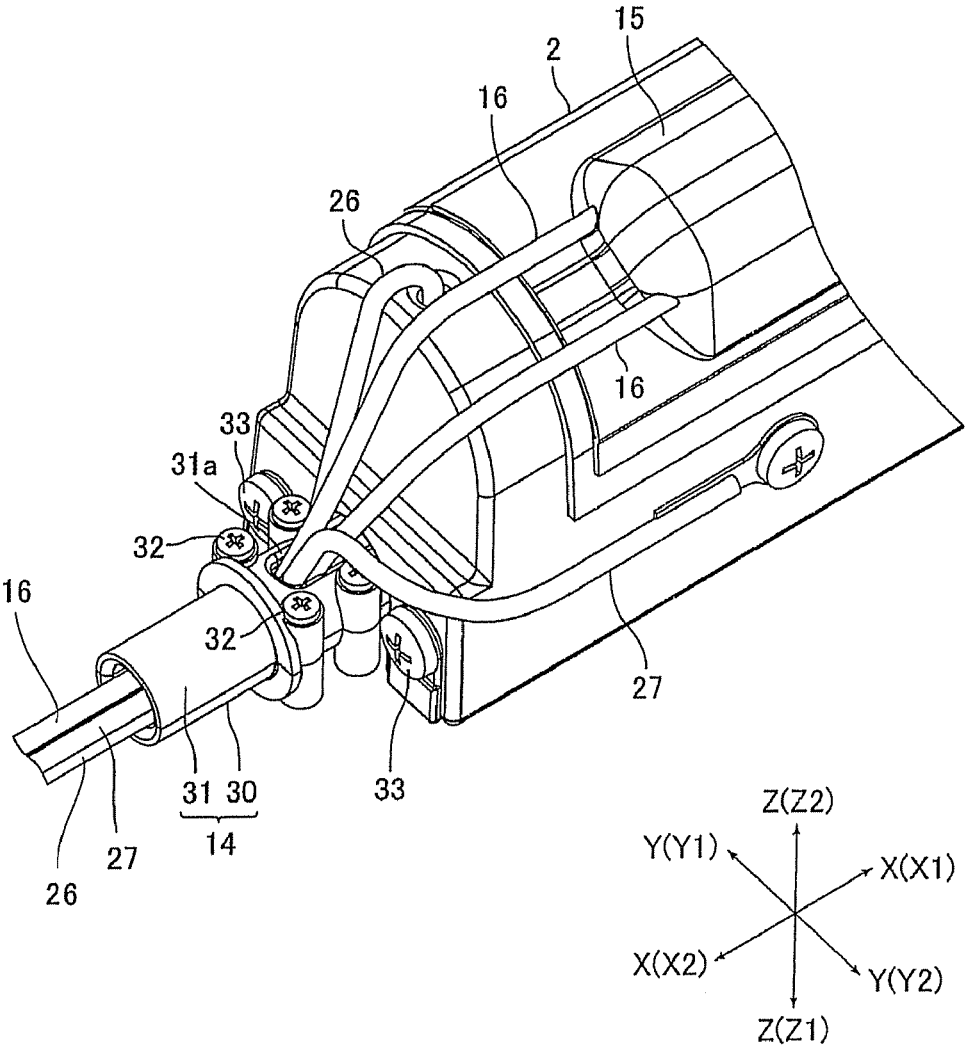
FIG. 8 is a perspective view showing a part of the ice tray, the engaging tube and the like which is viewed from the "E-E" direction in FIG. 7.
Figure 9:
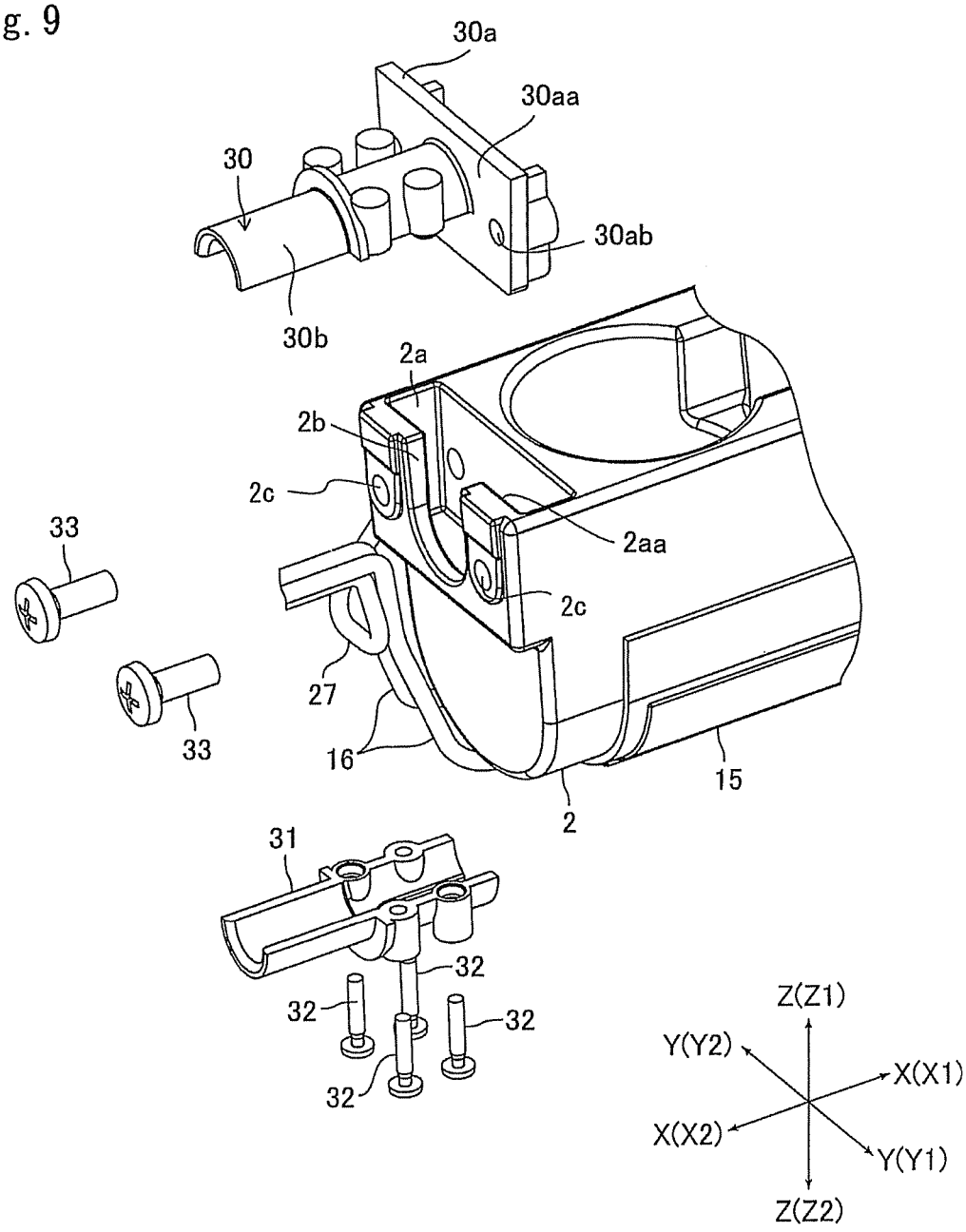
FIG. 9 is an exploded perspective view showing the engaging tube and the like shown in FIG. 7.
Figure 10:
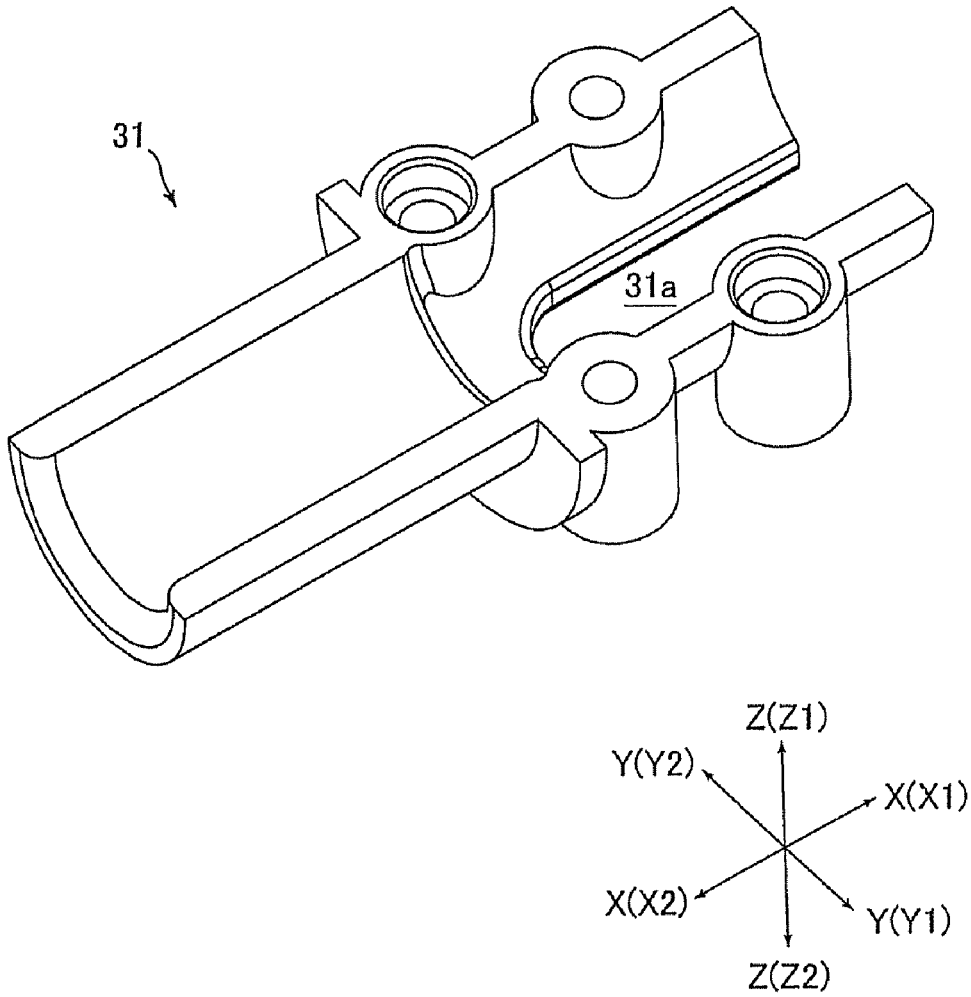
FIG. 10 is a perspective view showing a second engaging tube piece shown in FIG. 9.

FIG. 6 is a perspective view showing a state where the cooling mechanism 6 and the like are detached from the ice making device 1 shown in FIG. 1, and which is viewed from a different direction. FIG. 7 is a perspective view showing the ice tray 2, the engaging tube 14 and the like shown in FIG. 6. FIG. 8 is a perspective view showing a part of the ice tray 2, the engaging tube 14 and the like which is viewed from the "E-E" direction in FIG. 7. FIG. 9 is an exploded perspective view showing the engaging tube 14 and the like shown in FIG. 7. FIG. 10 is a perspective view showing a second engaging tube piece 31 shown in FIG. 9.

As described above, the connecting wires 16 connected to the heater 15 are drawn out to the left side from the ice making device 1. Specifically, as shown in FIG. 6 and the like, the connecting wires 16 are drawn out to the left side from the ice making device 1 so as to pass through the inner side of the engaging tube 14. In this embodiment, a thermistor (not shown) for detecting a temperature of the ice tray 2 is mounted on the ice tray 2 and a connecting wire 26 connected to the thermistor is drawn out together with the connecting wires 16 to the left side from the ice making device 1 (see FIG. 8). Further, a connecting wire 27 for grounding of the heater 15 is mounted on the ice tray 2 and a connecting wire 27 is also drawn out together with the connecting wires 16 to the left side from the ice making device 1 (see FIG. 8).

End parts of the connecting wires 16, 26 and 27 are, as shown in FIG. 6, connected with a connector 28. An outer shape of the connector 28 is formed larger than the inner diameter of the engaging tube 14.

The engaging tube 14 is structured of a first engaging tube piece 30 and a second engaging tube piece 31 which are engaging projection pieces divided by a face parallel in the right and left direction, i.e., in an axial direction of the engaging tube 14. In this embodiment, a dividing face of the engaging tube 14 which is an abutting face of the first engaging tube piece 30 with the second engaging tube piece 31, in other words, a joined face of the first engaging tube piece 30 with the second engaging tube piece 31, is set to be substantially parallel to the XY-plane. In other words, the dividing face of the engaging tube 14 is substantially parallel to the horizontal plane. Further, the dividing face of the engaging tube 14 is formed on a plane passing an axial center of the engaging tube 14. In other words, the engaging tube 14 is substantially bisected into two engaging tube pieces, i.e., into the first engaging tube piece 30 and the second engaging tube piece 31, and the first engaging tube piece 30 and the second engaging tube piece 31 are formed in a roughly half-cylindrical shape.

The first engaging tube piece 30 and the second engaging tube piece 31 are fixed to each other with screws 32. In this embodiment, as shown in FIG. 7 and the like, the first engaging tube piece 30 is disposed on the upper side and the second engaging tube piece 31 is disposed on the lower side.

As shown in FIG. 9, a recessed part 2*a* for fixing the first engaging tube piece 30 is formed in an upper face of the left side end of the ice tray 2. Further, the ice tray 2 is formed with an arrangement hole 2*b* whose bottom part is formed in a semicircular shape for disposing the right side end of the engaging tube 14 so as to pass from the recessed part 2*a* for fixing to the left side end of the ice tray 2.

A flange-shaped plate part 30*a* for fixing which is disposed within the recessed part 2*a* for fixing is formed at the right-side end of the first engaging tube piece 30. The engaging tube 14 is fixed to the upper end side of the left side end of the ice tray 2 with screws 33 in a state where the plate part 30*a* is disposed within the recessed part 2*a* and the right-side end of the engaging tube 14 is disposed in the arrangement hole 2*b*. The plate part 30*a* for fixing is formed in a direction perpendicular to the cylindrical part 30*b* of the first engaging tube piece 30 and the plate part 30*a* is formed with screw holes 30*ab* to which the screw 33 is fastened and fixed. Therefore, when the screws 33 are fastened to the screw holes 30*ab* which are formed in the plate part 30*a* through the holes 2*c* which are formed in the ice tray 2, an outer planar surface 30*aa* as an abutting part of the plate part 30*a* is abutted with an inner wall face 2*aa* of the recessed part 2*a* and thus the first engaging tube piece 30 is fixed without inclination at the left side end of the ice tray 2. In other words, the engaging tube 14 which is structured of the first engaging tube piece 30 and the second engaging tube piece 31 that is fixed to the first engaging tube piece 30 is fixed without inclination at the left side end of the ice tray 2.

An aperture groove 31*a* formed in a substantially U-shape is formed at the right side end of the second engaging tube piece 31 for drawing the connecting wires 16, 26 and 27 into the inner side of the engaging tube 14 (see FIG. 10). In this embodiment, the connecting wires 16, 26 and 27 which are arranged on an outer side of the ice tray 2 are drawn into the inner side of the engaging tube 14 through the aperture groove 31*a* which is formed on the lower side on the right side of the engaging tube 14 and is arranged generally perpendicular to the longitudinal axis of the engaging tube, and then the connecting wires 16, 26 and 27 are passed through the inner side of the engaging tube 14 to be drawn out to the left side from the ice making device 1. In this embodiment, the plate part 30*a* of the engaging tube 14 is fixed to the ice tray 2 through the recessed part 2*a* which is formed in the inner side of the ice tray 2. In this case, the second engaging tube piece 31 is formed with an aperture groove 31*a* for drawing the connecting wires 16, 26 and 27 into the inside and thus, even when the connecting wires 16, 26, 27 are arranged on the outer side of the ice tray 2, the connecting wires 16, 26, 27 are easily passed through the inner side of the engaging tube 14.

As described above, in this embodiment, the connecting wires 16 connected to the heater 15, the connecting wire 26 connected to the thermistor and the connecting wire 27 mounted on the ice tray 2 are drawn out to the left side from the ice making device 1 so as to pass through the inner side of the engaging tube 14 which is engaged with the guide groove 3*f* and the drive groove 5*a*. Therefore, even when the ice tray 2 is moved between the water-supply position and the ice making position, damage of connecting wires 16, 26 and 27 due to biting of the connecting wires 16, 26 and 27 at the time of movement of the ice tray 2 are prevented.

In this embodiment, the engaging tube 14 is divided into the first engaging tube piece 30 and the second engaging tube piece 31 by a plane which is parallel to the right and left direction. Therefore, even when one ends of the connecting wires 16, 26 and 27 are fixed to the ice tray 2 and the other ends of the connecting wires 16, 26 and 27 are connected to another component such as a connector, after the connecting wires 16, 26 and 27 have been disposed in one of the first engaging tube piece 30 and the second engaging tube piece 31, the first engaging tube piece 30 and the second engaging tube piece 31 are joined and fixed to each other and, as a result, the connecting wires 16, 26 and 27 are drawn out through passing the inner side of the engaging tube 14. Therefore, drawing operation of the connecting wires 16, 26 and 27 are easy.

Further, in this embodiment, the connector 28 having an outer shape larger than the inner diameter of the engaging tube 14 is connected with the end parts of the connecting wires 16, 26 and 27. Therefore, in a case that the engaging tube 14 is not divided by a plane parallel to the right and left direction, the connector 28 is required to connect with the end parts of the connecting wires 16, 26 and 27 after the connecting wires 16, 26 and 27 have been passed through the inner side of the engaging tube 14 and thus treatment of the connecting wires 16, 26 and 27 is complicated and not easy. On the other hand, in this embodiment, even when the connector 28 has been connected with the end parts of the connecting wires 16, 26 and 27, the connecting wires 16, 26 and 27 can be drawn out in the state they are passed through the inner side of the engaging tube 14. In other words, the connector 28 can be connected with the end parts of the connecting wires 16, 26 and 27 before the connecting wires 16, 26 and 27 are passed through the inner side of the engaging tube 14. Therefore, treatment of the connecting wires 16, 26 and 27 is easy.

In this embodiment, the dividing face of the engaging tube 14 is formed on the plane passing through the axial center of the engaging tube 14, and the engaging tube 14 is substantially bisected in the circumferential direction into two engaging tube pieces, i.e., the first engaging tube piece 30 and the second engaging tube piece 31. Therefore, the opening portions of the first engaging tube piece 30 and the second engaging tube piece 31 formed by the dividing face of the engaging tube 14 becomes wider. Accordingly, operation for arranging the connecting wires in the first engaging tube piece 30 or the second engaging tube piece 31 becomes easy.

In this embodiment, the dividing face of the engaging tube 14 is set to be substantially parallel to the horizontal plane. Therefore, when the ice tray 2 is moved between the water-supply position and the ice making position, even when the engaging tube 14 is contacted with the under face of the guide groove 3*f* (specifically, the under face of the second groove part 3*k*) by the own weight of the ice tray 2, the joined part of the first engaging tube piece 30 with the second engaging tube piece 31 is hardly contacted with the under face of the guide groove 3*f*. Especially, in this embodiment, the dividing face of the engaging tube 14 is formed on the plane passing through the axial center of the engaging tube 14. Therefore, even when the engaging tube 14 is contacted with the under face of the guide groove 3*f* by the own weight of the ice tray 2, the joined part of the first engaging tube piece 30 with the second engaging tube piece 31 is hardly contacted with the under face of the guide groove 3*f*. Accordingly, in this embodiment, even when the engaging tube 14 is contacted with the under face of the guide groove 3*f* by the own weight of the ice tray 2, a frictional force between the engaging tube 14 and the guide groove 3*f* can be reduced and thus the driving force of the motor 19 can be reduced. Further, abrasion of the engaging tube 14 and the guide groove 3*f* can be restrained.

In this embodiment, the recessed part 2*a* for fixing is formed in the ice tray 2 and the plate part 30*a* for fixing which is disposed within the recessed part 2*a* is formed in the first engaging tube piece 30. Therefore, mounting operation of the engaging tube 14 on the ice tray 2 is easy. In this case, the plate part 30*a* is formed in the direction perpendicular to the cylindrical part 30*b* of the first engaging tube piece 30. Therefore, when the plate part 30*a* is fastened and fixed to the recessed part 2*a* of the ice tray 2 by the screws 33, the abutting flat face part 30*aa* of the plate part 30*a* is abutted with the inner wall face 2*aa* of the recessed part 2*a* to determine the posture or the direction of the first engaging tube piece 30. Accordingly, the first engaging tube piece 30, in other words, the engaging tube 14 is fixed to the ice tray 2 without inclination and thus the ice tray 2 can be moved along the guide groove 3*f* smoothly.

Although the present invention has been shown and described with reference to specific embodiments, various changes and modifications will be apparent to those skilled in the art from the teachings herein.

In the embodiment described above, the dividing face of the engaging tube 14 is set to be substantially parallel to the horizontal plane but the dividing face of the engaging tube 14 may be inclined to the horizontal plane. Further, in the embodiment described above, the dividing face of the engaging tube 14 is formed on the plane passing through the axial center of the engaging tube 14. However, the dividing face of the engaging tube 14 may be formed on the plane which does not pass the axial center of the engaging tube 14. For example, the dividing face of the engaging tube 14 may be formed on the horizontal plane passing through an upper side of the axial center of the engaging tube 14.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice tray;

a drive mechanism for moving the ice tray to a water supply position where water is supplied to the ice tray and to an ice making position where the water in the ice tray is frozen;

a guide plate which is formed with a guide groove for guiding the ice tray to the water supply position and to the ice making position;

an engaging projection which is provided on the ice tray and engaged with the guide groove;

a crank which is formed with a drive groove with which the engaging projection is engaged and which is connected with the drive mechanism for moving the ice tray;

a heater which is mounted on the ice tray; and a connecting wire which is connected to the heater;

wherein the engaging projection is an engaging tube having a longitudinal axis and is structured of two engaging tube pieces which are divided by a plane, and the connecting wire passes through an inner side of the engaging tube, wherein one of the two engaging tube pieces is formed with a side wall including an inner surface and an outer surface, and an aperture groove extending through the side wall from the inner surface to the outer surface in a direction generally perpendicular to the longitudinal axis of the engaging tube for passing the connecting wire through both of the aperture groove and the inner side of the engaging tube.

2. The ice making device according to claim 1, wherein the engaging tube is formed in a roughly cylindrical shape and a dividing face of the engaging tube which is an abutting face of the two engaging tube pieces is faulted on a plane passing through an axial center of the engaging tube.

3. The ice making device according to claim 1, further comprising a connector which is connected with an end part of the connecting wire, wherein the engaging tube includes an inner diameter, and the inner diameter of the engaging tube is smaller than an outer shape of the connector.

4. The ice making device according to claim 1, wherein the ice tray is formed with a recessed part for fixing the engaging tube piece, and the engaging tube piece is formed with a plate part which is disposed in the recessed part.

5. The ice making device according to claim 4, wherein the plate part is provided in one of the two engaging tube pieces and is formed with an abutting part which abuts with a wall face of the recessed part, and the other of the two engaging tube pieces is fixed to the one of the two engaging tube pieces and, when the one of the two engaging tube pieces is fixed to the recessed part, the abutting part is abutted with the wall face of the recessed part so that a direction of the engaging tube structured of the two engaging tube pieces to the ice tray is determined.

6. The ice making device according to claim 4, wherein the plate part is provided in one of the two engaging tube pieces.

7. The ice making device according to claim 6, wherein the plate part is formed with an abutting part which abuts with a wall face of the recessed part, and the other of the two engaging tube pieces is fixed to the one of the two engaging tube pieces and, when the one of the two engaging tube pieces is fixed to the recessed part, the abutting part is abutted with the wall face of the recessed part so that a direction of the engaging tube structured of the two engaging tube pieces to the ice tray is determined.

8. The ice making device according to claim 1, wherein the ice making device is provided with two cranks which are connected with the drive mechanism for moving the ice tray, and one of the two cranks is formed with the drive groove with which the engaging tube is engaged.

9. The ice making device according to claim 8, wherein the drive mechanism includes a motor as a drive source and a gear mechanism which is driven by the motor and the drive mechanism is mounted on one of two guide plates, one of the ends of the two cranks is fixed to a crank turning shaft whose both ends are turnably held by the two guide plates so as to be turnable with the crank turning shaft as a turning center, the two cranks are turned at both sides of the ice tray by the crank turning shaft which is turned through the gear mechanism, and the guide groove with which the engaging tube is engaged is formed in an other of the two guide plates.

10. The ice making device according to claim 1, further comprising a temperature sensor mounted on the ice tray, and a second connecting wire that is connected to the temperature sensor and arranged to pass through both of the aperture groove and the inner side of the engaging tube.

* * * * *